United States Patent [19]

Lemberger et al.

[11] 4,248,437

[45] Feb. 3, 1981

[54] BOARD GAME

[76] Inventors: Gary T. Lemberger, 570 S. Broadway, Nyack, N.Y. 10960; Ronald I. Lemberger, 25E Dunes La., Port Washington, N.Y. 11050

[21] Appl. No.: 971,696

[22] Filed: Dec. 21, 1978

[51] Int. Cl.[3] ..... A63F 3/00

[52] U.S. Cl. ..... 273/243; 273/249

[58] Field of Search ..... 273/243, 249, 248

[56] References Cited

U.S. PATENT DOCUMENTS

| | | | |
|---|---|---|---|
| 733,793 | 7/1903 | Arrioga | 273/243 |
| 1,030,414 | 6/1912 | Mansfield | 273/249 |

OTHER PUBLICATIONS

*The Way to Play*, pp. 12, 13. C. Diagram Visual Information, Ltd., 1975, ed. by Ruth Midgley.

*Primary Examiner*—Richard C. Pinkham
*Assistant Examiner*—Scott L. Brown
*Attorney, Agent, or Firm*—Staas & Halsey

[57] ABSTRACT

A game apparatus of chance and strategy, the game board having a plurality of beginning sections, a plurality of first, second and third intermediate sections, and an ending section. Each beginning section includes a series of similarly-identified locations assigned to a player. Each first intermediate section includes a series of locations and is contiguous with a corresponding one of the beginning sections. Each second intermediate section is similarly identified with predetermined locations in the first intermediate sections. Each third intermediate section includes a series of locations and is contiguous with a corresponding one of the second intermediate sections and separately connected to the ending section. The markers for a player are similarly-identified with predetermined sections and locations of the game board. The purpose of the game is to score their player markers by safely maneuvering them from the beginning section to the ending section. To determine increments of movement and elimination of player markers a pair of dice and one cube of six different colors, or a pair of cubes, each with six different colors, and one die are used.

22 Claims, 7 Drawing Figures

Fig. 3
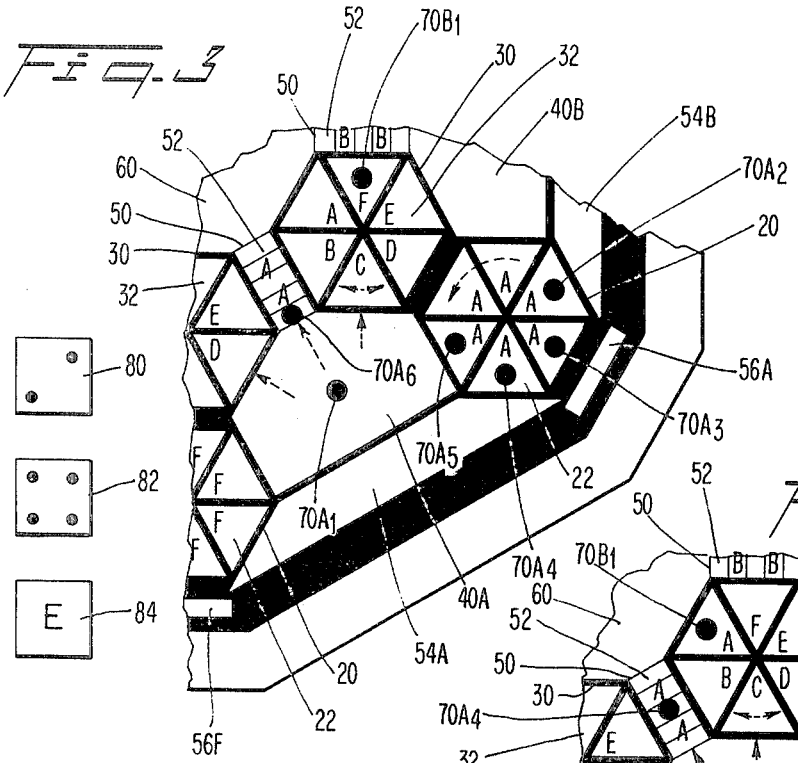
Fig. 4
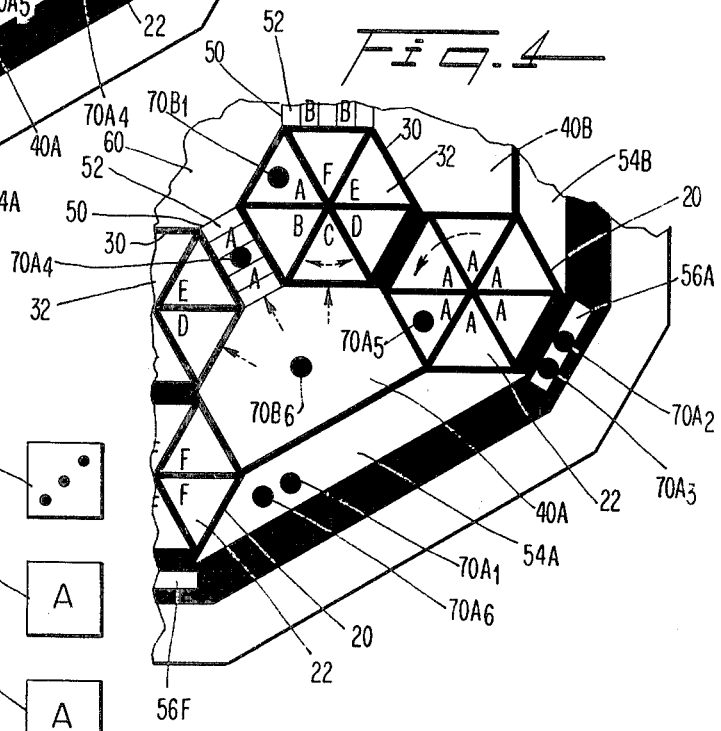
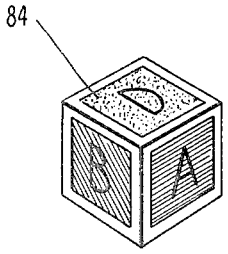
Fig. 5
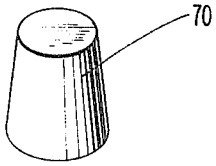
Fig. 6
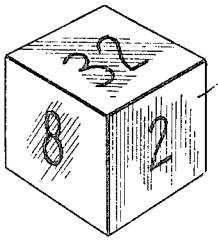
Fig. 7

BOARD GAME

BACKGROUND OF THE INVENTION

This invention relates to a game, and more particularly to a board game of chance and strategy for a plurality of players.

With the increasing amount of leisure time or at least time available to adult persons generally to play amusement devices, an increasing need has been felt for games which provide substantially non-repetitive play, require logic and intelligent decision-making during play, maintain a high degree of interest for an extended period of time of play, and provide a degree of chance in combination with strategy and logic.

Additionally, games of the type described above should be quickly and easily understood, adaptable for play not only by two but additional persons, and which can provide a selection of more sophisticated strategy options by mature players. Finally, games of this type should be adaptable for play by persons of different age levels, including adolescents.

SUMMARY OF THE INVENTION

Accordingly, it is a primary object of this invention to provide a game which is quickly and easily understood.

It is another object of the invention to provide a game which has substantially non-repetitive play.

Still another object of this invention is to provide a game which requires logic and intelligent decision-making during play.

Another object of this invention is to provide a game which maintains a high degree of interest for an extended period of play time.

Still another object of this invention is to provide a game having a combination of both strategy and chance.

Yet another object of this invention is to provide a game which can provide a selection of more sophisticated strategic options by mature players.

Finally, it is an object of this invention to provide a game which can be played by not only two but more persons and by players of different age levels, including adolescents.

Additional objects and advantages of the invention will be set forth in part in the description which follows and in part will be obvious from the description, or may be learned by practice of the invention. The objects and advantages of the invention may be realized and obtained by means of the instrumentalities and combination particularly pointed out in the appended claims.

To achieve the foregoing objects and in accordance with the purpose of the invention, as embodied and broadly described herein, the game apparatus of chance and strategy for a plurality of players comprises: (1) a game board having—(a) a plurality of beginning sections, wherein each beginning section includes a series of similarly-identified locations assigned to a player; (b) a plurality of first intermediate sections, wherein each first intermediate section includes a series of locations and is contiguous with a corresponding one of the beginning sections; (c) a plurality of second intermediate sections, wherein each second intermediate section is similarly identified with predetermined locations in the first intermediate sections; (d) a plurality of third intermediate sections, wherein each third intermediate section includes a series of locations and is contiguous with a corresponding one of the second intermediate sections; and (e) an ending section separately connected to each of the third intermediate sections; (2) a plurality of markers for a player for movement around sections and locations on the board, wherein the plurality of markers are initially positioned in a beginning section and are similarly-identified with predetermined sections and locations of the game board; (3) first means for indicating increments of movement for the player markers on the board; and (e) means for identifying sections and locations on the board for movement of the player markers.

It is preferred that the game apparatus further comprises third means for identifying predetermined sections and locations on the board to eliminate a player marker located thereon, and fourth means for indicating increments of movement of player markers to predetermined sections and locations on the board whereby another player marker located thereon can be eliminated.

In a preferred embodiment of the invention, the first and fourth indicating means comprise a pair of dice and the second and third identifying means comprise a pair of cubes having designations identifiable with sections and locations on the board.

In the above preferred embodiment, each of the two cubes has six different colors, the plurality of beginning sections comprise six sections of the six different colors, with each beginning section having six locations of the same color, the plurality of first intermediate sections comprise six sections with each first intermediate section having six locations of the six different colors, the plurality of second intermediate sections comprise six sections of the six different colors, and the plurality of player markers for a player comprise at least six markers of one color of the six different colors initially positioned on the six locations of the beginning section of the same one color.

It is preferred that a player marker be movable from a first intermediate section to a second intermediate section when a player marker can be incrementally moved to a location of the first intermediate section based upon the increment thrown on the die and when the color of the second intermediate section matches the color thrown on the color cube and the color of the location of the first intermediate section to which the player can be incrementally moved.

It is further preferred that another player marker may be eliminated from the game board when in a location of a first intermediate section of a color other than the color of that player marker and the color of that first intermediate section location matches the color thrown on the color cube.

Each third intermediate section has certain locations of a color of the six different colors and a marker of one player may be eliminated from the game board when in locations of the first or third intermediate sections, other than the third intermediate section location having a color matching the color of the one player's marker located thereon, and a marker of another player can be moved to that location based on the throw of the dice and cubes.

Finally, it is preferred that the game apparatus include means for doubling a stake agreed upon by the players of the game when the color of the color cube thrown by a player is the same color as that player's markers.

BRIEF DESCRIPTION OF THE DRAWINGS

The accompanying drawings, which are incorporated in and constitute a part of this specification, illustrate an embodiment of the invention and, together with the description, serve to explain the principles of the invention.

FIG. 3 is a second illustration of typical positions of player markers on a segment of the game board for possible movement based upon the throw as shown of a pair of dice and a single color cube which are employed in the preferred embodiment of FIG. 1;

FIG. 4 is a third illustration of typical positions of player markers on a segment of the game board for possible movement based upon the throw as shown of a single dice and a pair of color cubes which are employed in the preferred embodiment of FIG. 1;

FIG. 5 is a perspective view of one of the color cubes employed in the preferred embodiment of FIG. 1;

FIG. 6 is a perspective view of one of the player markers employed in the preferred embodiment of FIG. 1; and, FIG. 7 is a perspective view of a doubling cube which may be employed with the preferred embodiment of FIG. 1.

DETAILED DESCRIPTION OF THE PREFERRED EMBODIMENT

Reference will now be made in detail to the present preferred embodiment of the invention, an example of which is illustrated in the accompanying drawings.

In accordance with the invention, the game apparatus is a board game of chance and strategy for a plurality of players. The Board game comprises a game board, player markers for movement on the game board, means for indicating increments of movement for the player markers on the board, and means for identifying sections and locations on the game board for movement of the player markers. As herein embodied, the board game further comprises means for identifying predetermined sections and locations on the board to eliminate a player marker located thereon and means for indicating increments of movement for player markers to predetermined sections and locations on the board whereby other player markers located thereon can be eliminated.

Figure 1:
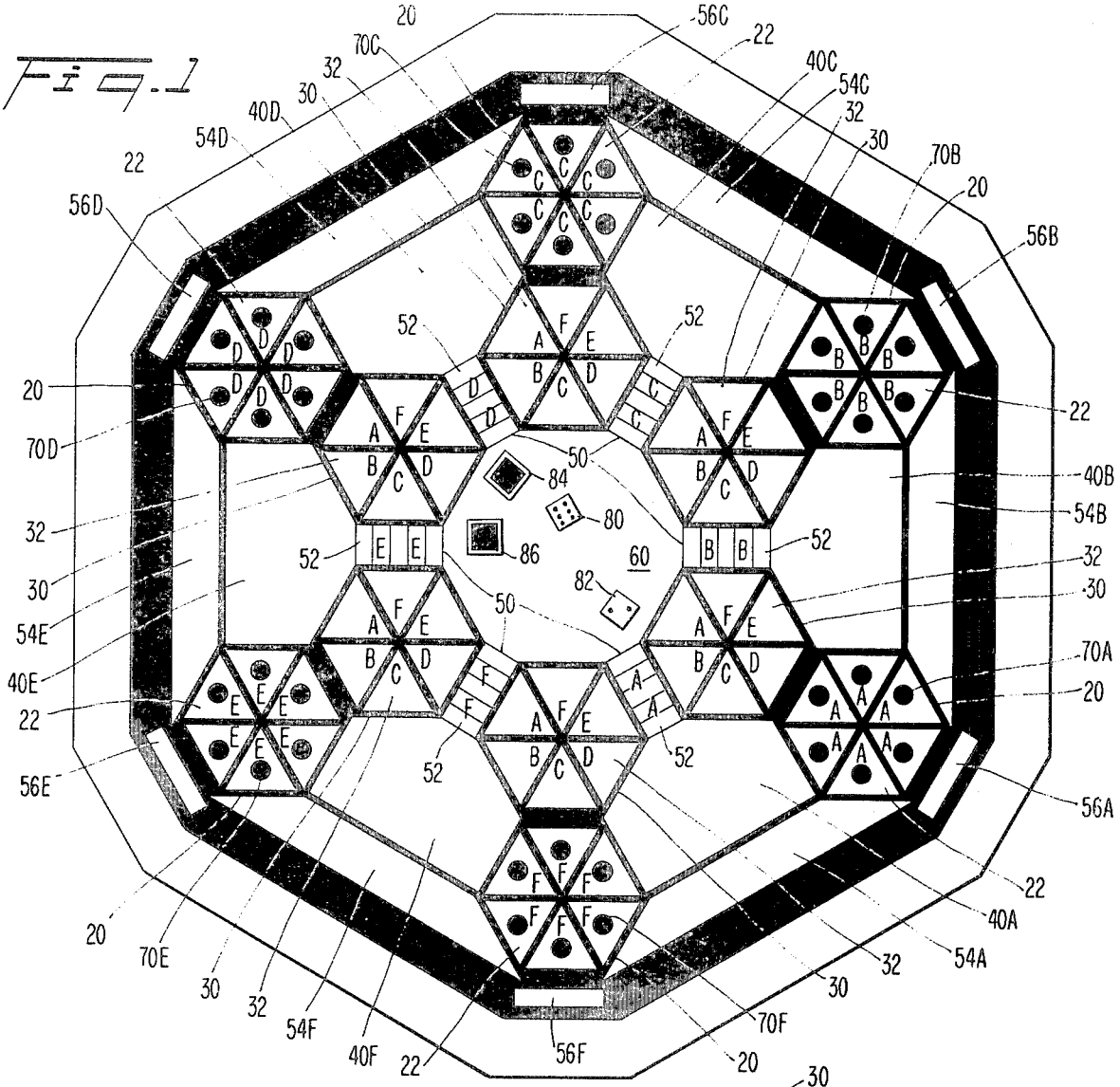
FIG. 1 is a top plan view of the game board along with the other various player devices of a preferred embodiment of the game apparatus employing the teachings of the present invention.

As here embodied, and best shown in FIG. 1, a game board 10 includes a plurality of beginning sections 20 where each beginning section 20 includes a series of similarly-identified locations 22 assigned to a. player. Board 10 further includes a plurality of first intermediate sections 30 where each first intermediate section 30 is contiguous with a corresponding one of the beginning sections 20 and includes a series of locations 32. A plurality of second intermediate sections 40 is similarly-identified with predetermined locations of the first intermediate sections 30. There is also a plurality of third intermediate sections 50 where each third intermediate section 50 is contiguous with a corresponding one of the second intermediate sections 40 and includes a series of locations 52. Finally, game board 10 includes an ending section 60 separately connected to each of the third intermediate sections 50.

In the preferred embodiment of the invention shown in FIG. 1, the game board 10 is formed in an overall hexagonal-like configuration having a center point. The ending section 60 is of a similar but smaller hexagonal-like configuration and is positioned at the center of the game board 10. Extending around the circumference of the ending section 60, there is positioned the plurality of first and third intermediate sections 30 and 50, respectively, in alternating fashion.

The first intermediate sections 30 are formed as hexagons with each first section 30 having six locations 32 in the form of triangles around the center of the hexagon. The third intermediate sections 50 are in the form of rectangles with each third intermediate section 50 having a series of five smaller rectangular locations 52 in a linear array.

In the preferred embodiment shown in FIG. 1, along the outer periphery of the first and third intermediate sections 30 and 50, respectively, the beginning sections 20 are positioned alternatingly with the second intermediate sections 40. Each of the beginning sections 20 is a hexagon which includes a series of six locations in the form of triangles located around the center of the hexagon. Each of the second intermediate sections 40 is a six-sided configuration wherein a first pair of opposing sides of the section 40 adjoins a corresponding pair of beginning sections 20, while a second pair of sides of the sections 40 adjoins a corresponding pair of contiguous first intermediate sections 30. The radially inward side of each of the second intermediate sections 40 adjoins the radially outward side of the corresponding third intermediate rectangular section 50.

Each of the beginning sections 20 has one of its locations 22 comprising an exit connected to one of the locations 32 of the contiguous first intermediate section 30 comprising an entry. As best shown in FIG. 1, a triangle 22 of each beginning section 20 which adjoins a triangle 32 of the contiguous first section 30 comprises the exit and entry, respectively. In similar fashion, each of the second intermediate sections 40 has an exit connected to a location of the corresponding third intermediate section 50 comprising an entry. As best shown in FIG. 1, the inner side of each section 50 which adjoins the first outward rectangle of the corresponding section 50 comprises the exit and entry, respectively. Each second intermediate section 50 further includes an exit connected to a location of at least one contiguous first intermediate section 30 which comprises an entry. As best shown in FIG. 1, the sides of the second intermediate sections 40 which adjoin triangles 32 of the contiguous first intermediate sections 30 comprise, respectively, the exits and entries.

Finally, each of the third intermediate sections 50 is provided with an exit which comprises the end rectangle 52 adjoining the ending section 60. As will be described in more detail below, the entries and exits of each of the sections described above are used for incremental movement of the player markers between sections on the game board.

Preferably, and as will be described in more detail below, at the outer periphery of the board game 10 between pairs of second intermediate sections 40, there are areas 54 for placement of player markers that are eliminated from the game board. On the outer periphery of the game board 10 adjacent each of the beginning sections 20 there are further provided areas 56 for placement of player markers that have reached the ending section 60.

It may be seen that the configuration of game board 10 of FIG. 1 provides a pleasant appearance to players of the game apparatus due to its symmetry. More particularly, the configuration of the game board allows an easy play of the game apparatus by a plurality of players who would normally seat themselves around the board. The board shown in FIG. 1 is designed for play by from two to six players. Different configurations may be made, however, to the game board and its section and locations without departing from the scope and spirit of the invention. For example, circles rather hexagonals can be utilized in another embodiment of the invention. It is contemplated that other geometric configurations could also be utilized.

In accordance with the invention, the game apparatus is provided with a plurality of markers 70 for movement around sections and locations on board 10. Markers 70 are similarly-identified with predetermined sections and locations of the game board, as will be described in more detail below, and are initially positioned in the beginning sections 20. As shown in FIG. 1, there are provided six sets of markers 70 with each set having six markers similarly-identified which are located in a beginning section 20. An example of a player marker 70 which may be utilized for movement on game board 10 is illustrated in FIG. 6.

A player marker 70 is movable on the board 10 from its beginning section 20 to the contiguous first intermediate section 30, and from one of the first intermediate sections 30 to one of the second intermediate sections 40 provided movement of the marker 70 is to a location in the first intermediate section 30 similarly-identified to one of the second intermediate sections 40. A player marker 70 is also movable from one of the second intermediate sections 40 to the contiguous third intermediate section 50 and, alternatively, from a second intermediate section 40 to any contiguous first intermediate section 30.

As here embodied, movement of a player marker 70 from a beginning section 20 to the contiguous first intermediate section 30 is achieved through the exit and entry triangles of locations 22 and 32 previously described. In similar fashion, movement of a player marker 70 from a second intermediate section 40 to the contiguous first section 30 or third intermediate section 50 is through the exit sides of section 40 and entry triangle 32 or rectangle 52 previously described. Finally, movement of a player marker from a third intermediate section 50 to the ending section 60 is achieved through the exit rectangle 52 previously described.

As will be set forth in more detail for the operational play of the game, movement of a player marker 70 within the beginning sections 20 and third intermediate sections 50 is unidirectional. Movement of a marker 70 within the second intermediate section 40 on the other hand is bidirectional, or as shown in FIG. 1 in a clockwise or counterclockwise direction about the center of the hexagon.

As herein embodied, means for indicating increments of movement for the player markers on the board and means for indicating increments of movement for the player markers to predetermined sections and locations on the board whereby another player marker located thereon can be eliminated comprise at least one die. Means for identifying sections and locations on the board for movement of the player markers and means for identifying predetermined sections and locations on the board to eliminate a player marker located thereon comprise at least one cube having designations identifiable with sections and locations on the board. In the preferred embodiment of the invention shown in FIG. 1, a pair of dice 80 and 82 and a pair of cubes 84 and 86 are used to determine incremental movement and elimination of player markers 70 on the game board 10.

Preferably, the dice 80 and 82 indicate increments of movement of a player marker 70 within the board sections 20, 30 and 50, and from a beginning section 20 to a first intermediate section 30, from a second intermediate section 30 to a first section 30 or third intermediate section 50, and from a third intermediate section 50 to the ending section 60. In addition, the dice 80 and 82 indicate increments of movement for a player marker 70 to predetermined sections and locations on the board whereby another player marker 70 located thereon can be eliminated. As herein embodied another player marker 70 can be eliminated from the board on locations 32 and 52 of the first and third intermediate sections 30 and 50, respectively.

The cubes 84 and 86 are used to identify predetermined sections and locations on the board 10 whereby a player marker 70 located thereon can be eliminated. Preferably, another player marker can be eliminated in locations 22 of the first intermediate sections 30. The dice 80 and 82 and cubes 84 and 86 are used to determine movement of a player 70 from a first intermediate section 30 to a second intermediate section 40. As will be described in more detail below, and as embodied herein, a player determines movement and elimination of player markers 70 on the game board 10 by selectively throwing the pair of dice 80 and 82 and one of the cubes 84 and 86, or the pair of cubes 84 and 86 and one of the dice 80 and 82.

As has been described, certain predetermined locations and sections of the game board 10 are identifiable with each other and with the markers 70, and the cubes 84 and 86. As herein embodied, in order to provide this identification, the board sections and section locations, the player markers, and the cubes are color-coded. In the preferred embodiment of FIG. 1, six different colors are utilized, and are designated herein by the letters A, B, C, D, E, and F. Each game board section and section location and player marker is shown with its respective color by use of the color letter in combination with the respective reference numeral.

For example, there are six beginning sections 20 of six different colors with each beginning section 20 having six locations or triangles 22 of the same color. Consequently, a first beginning section 20 has six triangles 22A, a second beginning section 20 has six triangles 22B, a third beginning section 20 has six triangles 22C, a fourth beginning section 20 has six triangles 22D, a fifth beginning section 20 has six triangles 22E, and a sixth beginning section 20 has six triangles 22F. Each of the six first intermediate sections 30 have six locations 32 of the six different colors A-F. The six second intermediate sections 40 are of the six different colors, and are designated as Sections 40A, 40B, 40C, 40D, 40E, and 40F.

Each third section 50 has certain of its rectangles 52 of a color. In the preferred embodiment shown in FIG. 1, one third intermediate section 50 has two locations 52 of color A, a second section 50 has two locations 52 of color B, another section 50 has two locations of color C, another section 50 has two locations 52 of color D, another section 50 has two locations 52 of color E, and a final section 50 has two locations 52 of color F.

In like fashion, each of the six areas 54 and 56 are color coded with the six different respective colors A through F, as best shown in FIG. 1.

The plurality of player markers 70 are broken down into six sets of player markers 70 with each set comprising six player markers 70 of one of the six different colors A-F. As shown in FIG. 1, the six player markers 70 of each set are positioned separately on the six beginning section triangles 22 of the same color. For example, the six player markers 70A are positioned separately on the six triangles 22A.

In order to identify the particular color-coded sections and locations on the game board 10 for determining movement and elimination of the player markers 70, each color cube 84 and 86 has its six sides identified with corresponding colors A-F. An example of one type of color cube for use in the board game is shown in FIG. 5.

Based upon the color coding as described above for the preferred embodiment of this game, a player marker 70 is movable from a first intermediate section 30 to a second intermediate section 40 when a player marker 70 can be incrementally moved to a triangle 32 of the first intermediate section 30 based upon the increments thrown on the die and when the color of the second intermediate section 40 matches the color thrown on the color cube and the color of the triangle 32 of the section 30 to which the player can be incrementally moved. A player marker 70 may be eliminated from the game board 10 when in a triangle 32 of a first intermediate section 30 of a color, other than the color of the player marker 70, that matches the color thrown on the color cube. Finally, a marker 70 of one player may be eliminated from the game board 10 when in a triangle 32 of a first section 30 or a rectangle 52 of a third section 50, other than on a rectangle 52 having a color matching the color of the one player's marker located thereon, and the marker of another player can be moved to that location based upon the throw of the dice and cubes.

Reference will now be made to the detailed operational play of the embodiment of the board game shown in FIG. 1. The overall purpose of the game is for a player to attempt to score as many possible of his player markers by safely maneuvering them from a beginning section 20 to the ending section 60. At the same time, each player strives to eliminate or bump the opponent's player markers from the board 10, preventing them from reaching the ending section 60. To provide easier play, the various sections and locations of the board 10 have designated names. A beginning section 20 is considered "Home", a first intermediate section 30—"Hazard", a second intermediate section 40—"Safety", a third intermediate section 50—"Goal Path", the ending section 60—"Goal", area 54—"Bump Keeper", and area 56—"Score Keeper." A player marker 70 is generally referred to as a "Man".

Normally, the players agree on the number of points to win. Several rounds are played until one player wins by reaching the agreed point total. For example, for two or three players, the total number of points needed to win can be fifteen (15) points, for four players twelve (12) points, and for five or six players, nine (9) points. A round ends as soon as one player's markers reach the Goal 60 or are bumped from the game board. Each player scores one point of each of its Men which reach the Goal. As soon as one player has enough Men reaching the Goal to bring his total score to the number of points chosen at the start of the game, play stops and that player is the winner.

As an alternative ending to the game, instead of ending the game as soon as a player reaches the chosen point total, the round is completed in the usual manner. At the end of the round, the player with the highest total of Men which have reached the Goal 60 is the winner. In case of a tie, the player who first reached the chosen total can be designated the winner. A player who does not have sufficient Men remaining in play to possibly win, removes his Men from the game board and drops out of the game.

Each player normally selects one color, A, B, C, D, E, or F, and places the six player markers 70, or Men, of that selected color on the six Home triangles 22 of that same color. In FIG. 1, there is shown the positioning of six sets of Men in the Home triangles 22. One player, for example, may choose the color A, and therefore positions the six Men 70A in the Home triangles 22A.

The first player is determined by throwing one of the color cubes 84 and 86. If the color thrown is not in play, that is, there are less than six players, one proceeds clockwise around the game board 10 from that color until a color in play is reached. Preferably, after the first player, play rotates to the left around the game board 10.

All Men 70 start in the Home of the color and move in a counterclockwise direction to the triangle 22 designated as an exit of that Home which is contiguous to a Hazard 30. In a Hazard 30, the Men can move in either direction. Once a Man has left its Home it can never return.

On each turn a player chooses to throw either the two dice 80 and 82 and one of the color cubes 84 and 86 or one of the dice and the two color cubes. If the player throws one die, the player moves one of its Men 70 the full number thrown, counting one move for each triangle to which it is moved. In leaving the Home section 20, it is not necessary for a man to stop on the exit triangle. In a Hazard 30, a Man must continue in the same direction until the full count is used. If a Man ends its move on a Hazard triangle that matches the color thrown on one of the color cubes, that Man can be transferred to the Safety section 40 of that color.

Figure 2:
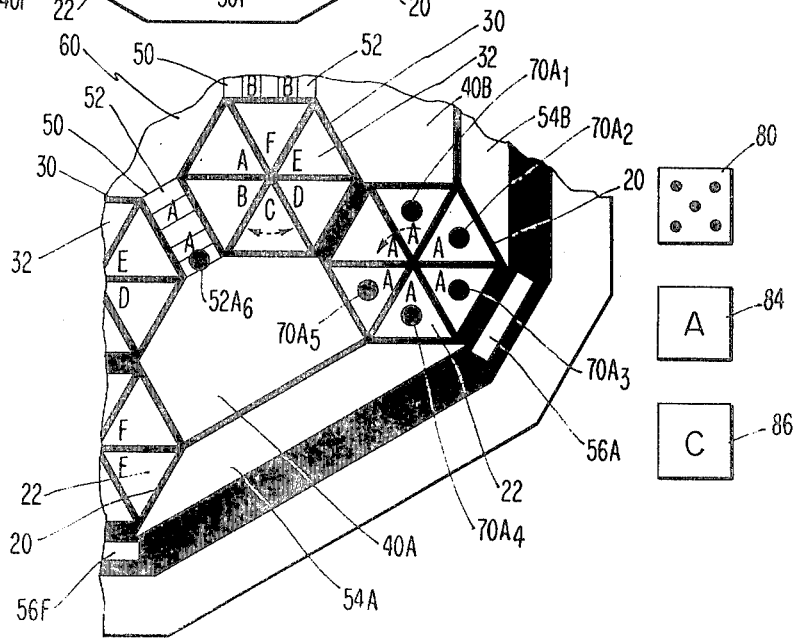
FIG. 2 is a first illustration of typical positions of player markers on a segment of the game board for possible movement based upon the throw as shown of a single dice and a pair of color cubes which are employed in the preferred embodiment of FIG. 1.

FIG. 2 illustrates an example of Men on a segment of the game board and a player of Men 70A has just thrown one die and two color cubes. Several plays are possible. The player may move Man $70A_1$, five increments as shown by die 80. If this is done, Man $70A_1$, would be positioned in the Hazard triangle 32A. Since the thrown color cube 84 shows color A, the Man $70A_1$, could then be transferred to the Safety 40A from Hazard triangle 32A.

Since in moving, a Man may never pass any other Man on the board, the player could not move his Men $70A_2$, $70A_3$, $70A_4$, and $70A_5$.

If player $70A_6$ was positioned in the Goal Path 50, however, as shown in FIG. 2 from a previous move, the player of Men 70A could alternatively move Man $70A_6$ five increments to the Goal 60 instead of moving its Man $70A_1$. Consequently, the Man $70A_6$ can be placed in the Score Keeper section 56A and that player has achieved one point in the round. It should be noted that once a Man has been moved into one of the Goal Paths 50 from the contiguous Safety section 40, that Man cannot be moved back. Furthermore, the Goal 60 must be reached by exact count on a die. In FIG. 2, if marker 70A$_6$, for example, was in another rectangle 52 in the Goal path 50, that Man could not have reached the Goal 60 by the count thrown on the die 80.

If a player elects to throw the two dice 80 and 82, and one of the color cubes 84 and 86, two different Men can be moved or one Man can be moved twice. For example, a Man can be moved in a Hazard for the number on one die and then moved either in the same direction or in the opposite direction for the number on the other side. A Man can also be moved for the number on one die so as to transfer from a Hazard to a Safety and then can be moved from the Safety using the other die.

If two men are moved to Hazard triangles matching the color on the one color cube thrown, both can be transfered to the Safety section of that color. With one exception, a Man may not end a move on the same space as another Man, unless that Man is being eliminated from the board, as will be described below. Any number of Men of any color can occupy a Safety at the same time.

A player must move if it is possible to do so. Consequently, if two dice are thrown, either may be moved first, even if that move makes it impossible for the second die to be used.

From a Safety, a Man is normally moved into the Goal Path connected thereto. However, a player can move a Man from a Safety into one of the two adjoining Hazards 30 for several objectives. First, a Man in a Safety can be moved to try to transfer to a different Safety because the Goal Path from the particular Safety is blocked by either his own Man or by an opposing player's Man, or because no other move is possible. Secondly, a Man may be moved from Safety to bump on opposing player's Man in a triangle of that Hazard.

Men 70 on the game board 10 can be bumped in two different ways. When a Man is bumped, it is immediately eliminated from the game board and placed in the Bump Keeper 54 of its color and is out of the play for the remainder of that round. The first way to bump is bumping by color. Any man who is in a Hazard 30, on a triangle other than its own color, is in danger of being bumped whenever the color of that triangle is thrown on a color cube. Regardless of which player throws the color, any player, including the owner of the Man, may call for one or more Men in danger to be bumped. Preferably, the call must be made before the player throwing the dice and cubes begins moving. If no call is made, a Man in danger remains in play. As herein embodied, a Man in a Safety is not in danger of being bumped whenever the color of that Safety is thrown on one of the color cubes.

The second way of bumping another Man on the game board is by moving a Man of the player who has thrown the dice and cubes. A player can bump an opposing player's Man, but not his own, by ending a move in the same space as the Man bumped. A Man on its own color in a Hazard is not safe against being bumped in this way, while a Man on its own color in a Goal Path is safe. A Man in a Safety is safe from being bumped in this manner.

FIG. 3 illustrates another example of Men positioned on a segment of the game board and a player of Men 70A who has just thrown two die and one color cube. Several plays are possible. For example, Man 70A$_1$ may be moved into the leftward adjoining Hazard by two increments shown on die 80 so that it falls on triangle 32E. Since the color E has been thrown on color cube 84, Man 70A$_1$ can be transferred to the Safety 40E (FIG. 1). As an alternative, Man 70A$_1$ may be moved to the rightward adjoining Hazard, by using the increment 4 shown on die 82, to fall on triangle 32F. Since an opposing player's marker 70B$_1$ is positioned on that location 32F, Man 70A$_1$ bumps that Man 70B$_1$ by its movement thereto. If this is done, Man 70B$_1$ is eliminated from the game board and placed in the Bump Keeper 54B for the player of the markers 70B. Man 70A$_1$ cannot be moved into the Goal Path 50 because of it being blocked by Man 70A$_6$. After movement of Man 70A$_1$, a second Man, such as 70A$_2$, can be moved by the increment of the remaining die.

As a further alternative of movement of Men shown in FIG. 3, the player may move first its Man 70A$_2$ four increments to the Hazard triangle 32E and thus place that Man 70A$_2$ in the safety 40E. As a second move, the Man 70A$_1$ may be moved two increments to the left into Hazard Triangle 32E and transferred to Safety 40E (FIG. 1) with the other Man 70A$_2$. Instead of moving Man 70A$_1$ marker two increments, the player could move the Man 70A$_6$ two additional increments in the Goal path 50 or Man 70A$_3$ two additional increments counterclockwise in the Home section 20. Still another movement can be Man 70A$_6$ four increments in the Goal Path 50 and two increments for Man 70A$_1$ into either the two adjoining Hazards or into the second rectangle 52 of the Goal Path 50.

It can be seen from the above illustrations that there are multiple uses for the color thrown on a color cube. Specifically, the color thrown on a color cube may be used for bumping one or more Men on the game board, for transferring one or more Men from a Hazard to a Safety, and for earning what will now be described as a Bonus.

When a player throws his own color on a color cube, he first takes his turn in the usual manner and then receives a bonus of one of the following:

1. The transfer of one of his Men from either his Home 20 or from a Hazard triangle of his own color to the Safety of his color; or 2. Another turn. If the player throws his own color on two color cubes, he may, as a bonus, either transfer two men or transfer one man and take another turn. If in an extra turn the player again throws his own color, he again receives a bonus. Preferably, there is no limitation with respect to bonuses.

FIG. 4 illustrates yet another example of Men positioned on a segment of the game board and a player of Men 70A who has just thrown one die and two color cubes. The two colors thrown are of his own color A. The player may move his Man 70A$_4$ by the three increments shown on die 80 to the Goal 60. As previously stated, the Goal 60 must be reached by exact count on a die. The Man 70A$_4$ is then placed in the Score Keeper 54A of its color with his other Men 70A$_2$ and 70A$_3$. In addition, since the player has thrown his color A on both cubes, as a bonus, he may transfer his Man 70A$_5$ to the Safety 40A and then take another turn.

If upon that other turn, the player rolls two die and one cube and one of the die indicates six incremental moves, he can move that Man 70A$_5$ now positioned in the Safety 40A through the Goal path 50 to the Goal 60. This last move would end the round since all his Men would either be in the Bump Keeper 54A or the Score Keeper 56A. As a score for that particular round, the player of Men 70A would have four points based upon the number of Men in the Score Keeper 56A, i.e., Men 70A$_2$, 70A$_3$, 70A$_4$, and 70A$_6$.

It may be seen that other variations can be made to the operational play of the above game without departing from the scope of the invention. For example, when two players are playing the game, each can use two colors, or each can use three colors. When three players are playing the game, each can use two colors. Players play one color in a turn, rotating the colors in a set order. Based upon this operation, two alternative methods of winning can be used: (1) a separate score being kept for each color with the player winning as soon as one of his colors reaches the chosen point total; or (2) the score for each player's colors being combined with the player winning when this combined score reaches the chosen point total. Regardless of which method of winning is used, a round ends as soon as any one color is completely moved to the Score Keeper 56 and/or Bump Keeper 54.

The game apparatus, in accordance with this invention, can further comprise means for doubling a stake agreed upon by the players of the game apparatus. In the preferred embodiment of FIG. 1, the players at the beginning of the game agree on the amount of a "stake". When a player throws his own color on one or two of the color cubes 84 and 86, he may call for a doubling of the stake, i.e., from one to two, from two to four, from four to eight, etc. To achieve this, a doubling cube 88, as illustrated in FIG. 7, may be used. The player must complete his turn, including any extra turns he chooses as bonuses, before calling for the double. If the player later throws his own color, he may again call for a double, even if no other player has called for a double in the interim.

When a player calls for a double, each of the other players can either accept the double and continue playing or can drop out, removing all of their Men. If a player drops out, he must contribute to the "pot". The contribution is the amount of the "stake" multiplied by the number before the double called for on the doubling cube 88.

Usually each round is a complete game. At the end of the round, unless all players except one drop before the end, the player with the highest score is the winner of the "pot" and each of the other players still in the game must contribute to the "pot", based upon the number on the doubling cube 88. In case of a tie for the highest score, the tied players may agree to split the "pot" or can play a tie-breaking round. In this round, further doubles may be called for.

Players may instead agree to play until one player reaches a chosen point total. In this case, doubles can be called for in each round.

As a variation to the above use of the doubling cube 88 for the game, the following exceptions can be made. When a player drops out, his "liability" is calculated by multiplying the stake by the number on the doubling cube 88 and by the difference between the player's score and the leading player's score. This amount is set aside. In addition to being able to drop out when a double is called for, a player may choose to drop out each time it is his turn. At the end of the game, the winning player collects all the liabilities from players who have dropped out, plus a similar liability from each player still in the game. Tied players can agree to split the winnings or can play a tie-breaking round.

For the preferred embodiment of the game apparatus as shown in FIG. 1, it can be seen that it is usually advantageous towards the beginning of a round to usually throw the two color cubes 84 and 86 and one of the dice 80 and 82 so as to earn more bonuses, allowing rapid transfer of Men into the Safety of the same color as the player's Men. When trying to bump by color, it is of course also preferable to throw the two color cubes 84 and 86. Secondly, once the player has most of his Men out of the Home section, it is usually preferable to throw the two dice 80 and 82 and one of the color cubes 84 or 86, particularly if a number of Men are in Safeties or in Goal Paths.

Since an opposing player's Men can be blocked from reaching the Goal from a Safety by placing a Man in the Goal Path leading from the Safety they occupy, it is usually advisable to move from that Safety. This is particularly important if the Man in the Goal Path is on a rectangle of its own color since it cannot be removed by bumping.

To avoid leaving a Man in a dangerous position, it is often possible to move a Man from a Safety into an adjacent Hazard so as to land on the triangle matching a color thrown on the color cube. The Man would then be transferred to the Safety of that thrown color. If a player has more Men in its Score Keeper 56 than the opposing players, it often pays to have a remaining Man of that player bumped so as to end the round before the opponent's Men have a chance to reach the Goal 60.

It will be apparent to those skilled in the art that various modifications and variations could be made in the game apparatus of the invention described and set forth above without departing from the spirit or scope of the invention. For example, there could be used other combinations of colors for the board sections, other types of identification, different combinations of board sections, different configurations of the board sections and locations, and different combinations of the dice and color cubes.

It can also be appreciated that in playing this game, there is an element of chance, since the progress of each player's Man is at least partly determined by the throw of the dice and cubes. On the other hand, there is a high degree of skill by the player in selecting the options and variations available to move Men in order to win a round and the game. The combination of this chance and strategy provides substantially a non-repetitive play, requires logic and intelligent decision-making during play, and maintains a high degree of interest for an extended period of time of play. Additionally, the game of this invention is quickly and easily understood, and is adapted for play not only by two but additional persons, as well as by persons of different age levels, including adolescents.

What is claimed is:

1. A game apparatus of chance and strategy for a plurality of players comprising:

(a) a game board having indicia for defining thereon (i) a plurality of differently-identified beginning sections, wherein each beginning section includes a series of similarly-identified subsections defined therein assigned to a player;

(ii) a plurality of first intermediate sections, wherein each first intermediate section includes a series of differently-identified subsections defined therein corresponding to similarly-identified beginning sections and wherein each first intermediate section is contiguous with a corresponding one of the beginning sections for defining a playing path therebetween;

(iii) a plurality of second intermediate sections, wherein each second intermediate section is similarly identified with one of the subsections in each of the first intermediate sections and is contiguous with at least one of the first intermediate sections for defining playing paths therebetween;

(iv) a plurality of third intermediate sections, wherein each third intermediate section includes a series of subsections for defining a playing path therein and is contiguous with a corresponding one of the second intermediate sections for defining a playing path therebetween; and, (v) an ending section separately connected to each of the third intermediate sections for defining a playing path therebetween;

(b) a plurality of markers for a player for movement around the plurality of first, second, and third sections and the series of subsections of the first and third sections on the board, wherein the plurality of markers for a player are similarly-identified with one of the beginning sections and second intermediate sections, one of the subsections in each of the first intermediate sections and predetermined subsections in one of the third intermediate sections for establishing play of the game and wherein the markers for a player are initially positioned in the similarly-identified beginning section (c) first means for indicating increments of movement for the player markers between the plurality of sections and series of subsections on the board; and (d) second means for identifying different sections and subsections on the board onto which player markers are movable for defining a playing path.

2. The game apparatus of claim 1 wherein said first means determines incremental movement of a player marker positioned on one of the subsections of the beginning section to one of the subsections of the contiguous first intermediate section.

3. The game apparatus of claim 2 wherein each beginning section has one location comprising an exit connected to a subsection of the contiguous first intermediate section comprising an entry, and wherein each beginning section defines a unidirectional path flow between subsections.

4. The game apparatus of claim 2 wherein said second means similarly identifies a subsection of one of the first intermediate sections with one of the second intermediate sections for establishing movement of a player marker located on the subsection of the first intermediate section to the similarly-identified second intermediate section.

5. The game apparatus of claim 4 wherein said first means defines incremental movement of a player marker from one of the second intermediate sections to one of the subsections of the corresponding contiguous third intermediate section.

6. The game apparatus of claim 5 wherein said first means defines incremental movement of a player marker from one of the subsections of the third intermediate sections to the ending section.

7. The game apparatus of claim 6 wherein each second intermediate section has an exit connected to a subsection of the corresponding third intermediate section comprising an entry, and wherein each third intermediate section defines a unidirectional path flow between subsections to the ending section.

8. The game apparatus of claim 5 wherein said first means defines incremental movement of a player marker from the second intermediate section to the at least one corresponding contiguous first intermediate section.

9. The game apparatus of claim 8 wherein each second intermediate section has an exit connected to a subsection of the at least one corresponding first intermediate section comprising an entry, and wherein each first intermediate section defines a bidirectional path flow between subsections.

10. The game apparatus of claim 1 further comprising:

(a) third means for identifying different sections and subsections on the board on which a player marker is located for elimination of the player marker in accordance with the play of the game; and, (b) fourth means for indicating increments of movement for player markers to predetermined sections and subsections on the board whereby another player marker located thereon can be eliminated.

11. The game apparatus of claim 10 wherein said third means identifies subsections of the plurality of first intermediate sections for elimination of a player marker located thereon in accordance with the play of the game and wherein said fourth means defines incremental movement of a player marker to one of the subsections of the first and third intermediate sections for elimination of another player marker located thereon.

12. The game apparatus of claim 11 wherein the first and fourth means comprise at least one die and the second and third means comprise at least one cube having designations identifiable with sections and subsections on the board.

13. A game apparatus of chance and strategy for a plurality of players comprising:

(a) a game board having indicia for defining thereon (i) a plurality of differently-identified beginning sections, wherein each beginning section includes a series of similarly-identified subsections defined therein assigned to a player and wherein one subsection comprises an exit;

(ii) a plurality of first intermediate sections, wherein each first intermediate section is contiguous with a corresponding one of the beginning sections and includes a series of differently-identified subsections defined therein corresponding to similarly-identified beginning sections with at least one subsection comprising an entry adjoining the exit of the corresponding beginning section for defining a playing path therebetween;

(iii) a plurality of second intermediate sections, wherein each second intermediate section is similarly-identified with one of the subsections in each of the first intermediate sections and is contiguous with at least one of the first intermediate sections for defining playing paths therebetween;

(iv) a plurality of third intermediate sections, wherein each third intermediate section is contiguous with a corresponding one of the second intermediate sections and includes a series of subsections for defining a playing path therein with a first subsection comprising an entry adjoining the corresponding second intermediate section for defining a playing path therebetween and a second subsection comprising an exit; and (v) an ending section separately connected to each of the third intermediate sections, wherein the ending section adjoins the exit of each of the third intermediate sections for defining a playing path therebetween;

(b) a plurality of markers for a player for movement around the plurality of first, second and third sections and the series of subsections of the first and third sections on the board, wherein the plurality of markers for a player are similarly-identified with one of the beginning sections and second intermediate sections, one of the subsections in each of the first intermediate sections and predetermined subsections in one of the third intermediate sections for establishing play of the game and wherein the markers for a player are initially positioned in a similarly-identified beginning section (c) means for indicating increments of movement for the player markers between the plurality of sections and series of subsections on the board and for indicating increments of movement for the player markers to predetermined sections and subsections on the board whereby another player marker located thereon can be eliminated, wherein the indicating means defines incremental movement of a player marker to one of the subsections of the first and third intermediate sections for elimination of another player marker located thereon, and wherein the indicating means defines incremental movement of a player marker between board subsections and from one of the subsections of a beginning section to one of the subsections of the contiguous first intermediate section, from a second intermediate section to one of the subsections of the first and contiguous third intermediate section, and from one of the subsections of a third intermediate section to the ending section; and (d) means for identifying different sections and subsections on the board onto which player markers are movable for defining a playing path and for identifying different sections and subsections on the board on which a player marker is located for elimination of the player marker in accordance with the play of the game, wherein said identifying means similarly identifies a subsection of one of the first intermediate sections with one of the second intermediate sections for establishing movement of a player marker located on the subsection of the first intermediate section to the similarly-identified second intermediate section and wherein said identifying means identifies subsections of the plurality of first intermediate sections for elimination of a player marker located thereon.

14. The game apparatus of claim 13 wherein the indicating means comprises a pair of dice and the identifying means comprises a pair of cubes having designations identifiable with different sections and subsections on the board and wherein the pair of dice and one cube or the pair of cubes and one die are selectively throwable to determine movement of players' markers between the different plurality of sections and series of subsections and to eliminate players' markers in accordance with the play of the game.

15. The game apparatus of claim 14 wherein each of the cubes has six different colors, the plurality of beginning sections comprise six sections of the six different colors with each beginning section having six subsections of the same color, the plurality of first intermediate sections comprise six sections with each first intermediate section having six subsections of the six different colors, the plurality of second intermediate sections comprise six sections of the six different colors, and the plurality of player markers for a player comprise at least six markers of one color of the six different colors initially positioned on the six subsections of the beginning section of the same one color.

16. The game apparatus of claim 15 wherein a player marker is movable from a first intermediate section to a second intermediate section when a player marker can be incrementally moved to a location of the first intermediate section based upon the increment thrown on the die and when the color of the second intermediate section matches the color thrown on the color cube and the color of the location of the first intermediate section to which the player can be incrementally moved.

17. The game apparatus of claim 16 wherein another player marker may be eliminated from the game board when in a location of a first intermediate section of a color other than the color of the player marker and the color of that first intermediate section location matches the color thrown on the color cube.

18. The game apparatus of claim 17 wherein each third intermediate section has certain subsections of a color of the six different colors and wherein a marker of one player may be eliminated from the game board when in locations of the first or third intermediate sections, other than on the third intermediate subsection having a color matching the color of the one player's marker located thereon, and a marker of another player can be moved to that subsection based upon the throw of the dice and cubes.

19. The game apparatus of claim 18 wherein the beginning and third intermediate sections define a unidirectional path flow between subsections and the first intermediate section defines a bidirectional path flow between subsections, and wherein a player marker is not movable past another player marker positioned on the game board.

20. The game apparatus of claim 15 further comprising means for doubling a stake agreed upon by the players of the game apparatus when the color of the color cube thrown by a player is the same color as that player's markers.

21. The game apparatus of claim 1 or 13, wherein the ending section is positioned in the center of the board, the first intermediate sections are positioned circumferentially around the ending section and alternatively between the third sections, the second intermediate sections are positioned circumferentially and alternatively between the beginning sections, the first intermediate sections are positioned radially between the ending section and the beginning sections, and the third sections are positioned radially between the ending section and the second sections.

22. The game apparatus of claims 1, 10 or 13 wherein the subsections of the beginning and first intermediate sections, the second intermediate section, the subsections of the third intermediate sections, the plurality of markers for each player, and the identifying means are color-coded for identification.

* * * * *